United States Patent [19]

Zieff

[11] Patent Number: 4,537,325

[45] Date of Patent: Aug. 27, 1985

[54] STORAGE CONTAINER CLOSURE

[75] Inventor: Mark P. Zieff, Lexington, Mass.

[73] Assignee: Dart Industries Inc., Northbrook, Ill.

[21] Appl. No.: 646,027

[22] Filed: Aug. 29, 1984

Related U.S. Application Data

[63] Continuation of Ser. No. 544,311, Oct. 21, 1983, abandoned.

[51] Int. Cl.[3] ..... B65D 53/00

[52] U.S. Cl. ..... 220/234; 222/563; 220/305

[58] Field of Search ..... 220/234, 237, 305; 222/563, 484, 479, 481, 482

[56] References Cited

U.S. PATENT DOCUMENTS 4,387,825 6/1983 Parent ..... 220/238

4,390,109 6/1983 Schulein et al. ..... 220/234

*Primary Examiner*—George T. Hall

*Attorney, Agent, or Firm*—A. Lewis Worthem, Jr.

[57] ABSTRACT

For containers with circular openings, a closure for selectively loosely covering or tightly sealing the container. A seal member has an elastically contractible peripheral bead. The throat opening of the container decreases in diameter in two steps, forming two annular ledges and a wall portion therebetween. The peripheral bead may rest loosely upon the first, larger ledge, and, when contracted, may be seated tightly upon the second, smaller ledge.

10 Claims, 6 Drawing Figures

STORAGE CONTAINER CLOSURE

This is a continuation of co-pending application Ser. No. 544,311 filed on Oct. 21, 1983; now abandoned.

BACKGROUND OF THE INVENTION

1. Field of the Invention

This invention relates to storage container closures, and more particularly to an improved closure for a container having a generally cylindrical throat opening and a seal member which may selectively be placed loosely in the throat opening upon a first ledge or tightly upon a second ledge.

2. Description of the Prior Art

Circumstances may arise where a sealable container is needed for medium-term or long-term storage of articles or substances, yet it is desirable for the container to be easily openable for frequent or repetitive access to its contents. One common instance is the use of an ice bucket to store or transport ice cubes followed or preceded by use of the same bucket for dispensing ice at a social gathering such as a party or picnic. While a firm, positive seal of the bucket is desirable during transport and storage, a loose, easily opened closure of the bucket is preferred during the frequent access to the ice at the gathering.

Storage containers heretofore available have been provided with closures intended for either tight sealing or loose covering, but not both. Although it may be possible to loosely cover a container with a lid intended for tight sealing, typically no means are provided maintaining the lid in a proper orientation and relationship with the container, e.g., the lid may rest skewed and leave gaps or may bind or become stuck. Similarly, containers provided with closures intended for loose covering are typically not provided with means for obtaining a tight seal using the same parts.

U.S. Pat. No. 3,756,480, which is incorporated herein by reference, discloses a three-part press type seal comprising a locally distortable closure member contractably and distensibly constructed and having an elastic memory such that it is adapted to hermietically seal an open-mouthed container. The seal has a peripheral bead which may be contracted from a first diameter to a second smaller diameter by depressing a plunger which distorts a seal member formed integrally with the bead. Also disclosed is the use of such a seal to tightly close a container having a generally circular throat with a cylindrical wall and an annular ledge below the wall which are sealingly engaged by the seal bead.

Accordingly, there is a need for a container closure adapted for two modes of closing, a first in which the closure member rests loosely upon the container and is easily removed or replaced, yet which provides a uniform closing of the container, and a second in which the closure member tightly seals the container. Furthermore, it is desirable for such a closure to have insulative properties when used in a container with hot or cold contents.

SUMMARY OF THE INVENTION

The present invention meets the aforementioned needs by providing a closure for a container having a generally circular throat opening and a closure member having an elastically distortable seal member with a peripheral bead portion which is selectively contractable from a first bead diameter to a second, smaller bead diameter. The container throat is configured with a substantially cylindrical upper wall portion of a diameter greater than the first bead diameter, and an adjacently substantially cylindrical lower wall portion of a diameter less than the first bead diameter but no smaller than the second bead diameter. A first inwardly projecting annular ledge is situated between the upper and lower wall portions. A second inwardly projecting annular ledge is situated immediately below the lower wall portion. When the closure member is placed loosely on the container, the peripheral bead rests upon the first ledge encircled, but not engaged, by the upper wall portion. When the peripheral bead is selectively contracted by a distorting force, the closure member may be inserted farther into the container throat with the peripheral bead resting upon the second ledge. The distorting force may then be released, and the peripheral bead will then be sealingly engaged with lower wall portion and seated upon the second ledge.

According to a feature of a preferred embodiment of the invention, the closure member is provided as a three-part press type seal according to the disclosure of U.S. Pat. No. 3,756,480. According to another feature, it is contemplated that the container may be an ice bucket or the like. In this preferred embodiment, the dead air space within the three-part press type seal is used in a novel way for its insulative value.

Further objects and features of the invention will become apparent from the detailed description of a preferred embodiment which follows.

DESCRIPTION OF THE PREFERRED EMBODIMENT

Figure 1:
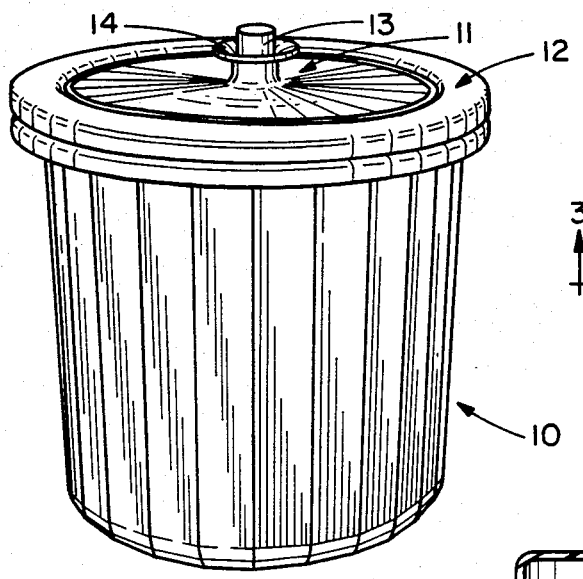
FIG. 1 is a perspective view of a covered ice bucket embodying the invention.
Figure 2:
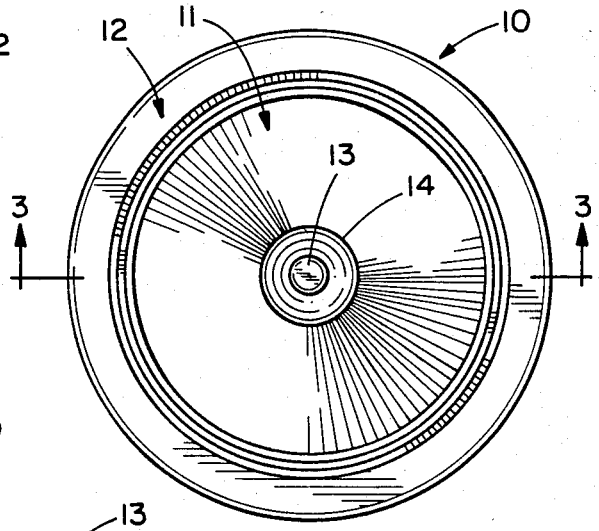
FIG. 2 is a top plan view of the ice bucket of FIG. 1.

By way of disclosure of a preferred embodiment of the invention and not by way of limitation, there is shown in FIGS. 1 and 2 an ice bucket comprising a container indicated generally at 10 and a seal 11. The container 10 is substantially cylindrical with a closed bottom and a generally circular throat opening. The seal 11, shown in the tightly sealed position, sits within the throat of the container 10. There is an upper circumferential rim 12 on the container 10. The seal 11 has a protruding plunger 13 in its center encircled by a flared flange 14.

Figure 3:
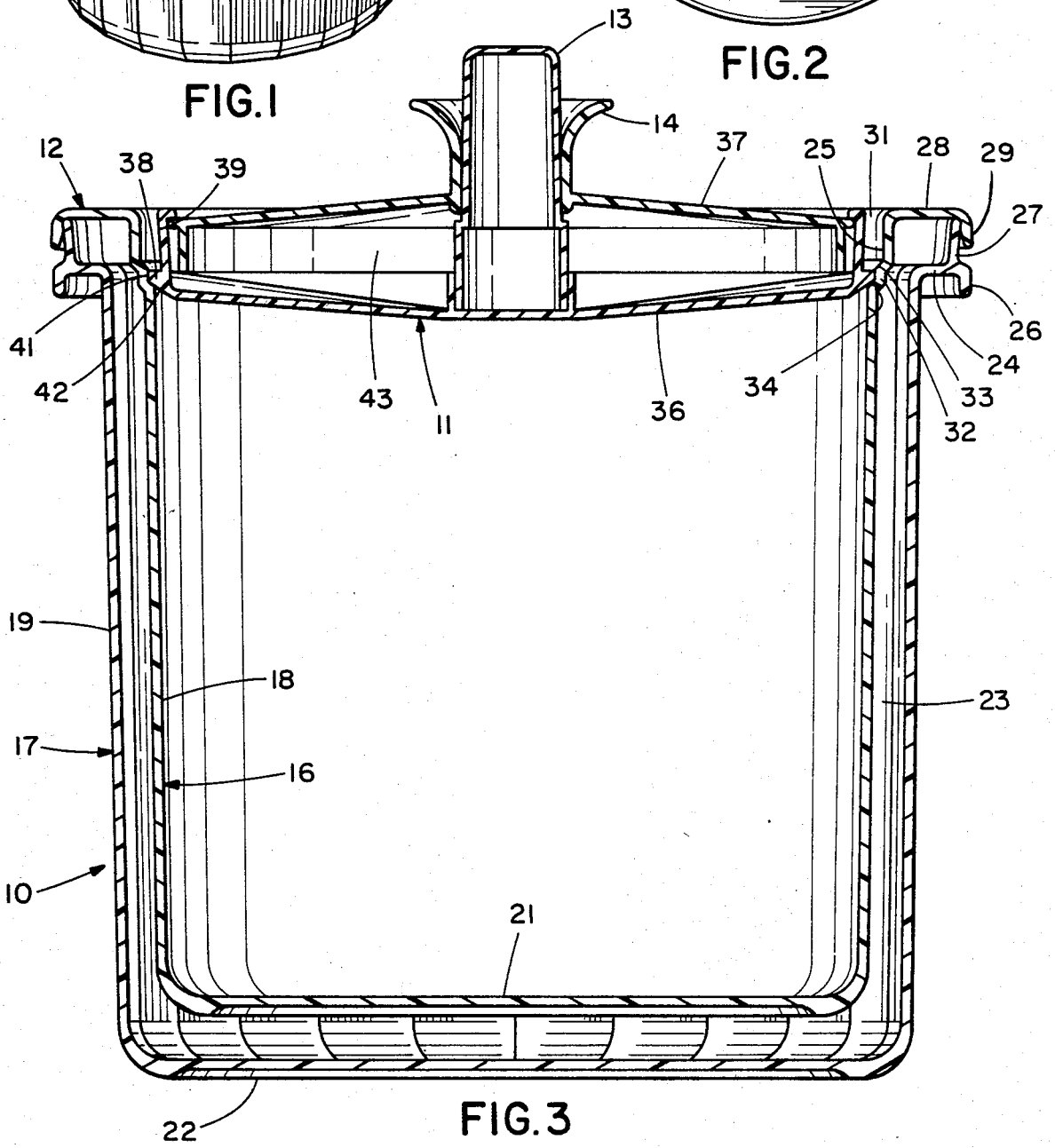
FIG. 3 is a sectional side view taken along the line 3—3 of FIG. 2.

As best shown in FIG. 3, the container 10 is constructed in two parts comprising an outer container 17 and an inner container 16 nested within the outer container 17. The inner 16 and outer 17 containers each respectively have a substantially cylindrical wall 18, 19 and a substantially planar bottom 21, 22. The outer container 17 is somewhat larger than the inner container 16 so that a dead air space 23 is formed therebetween.

Encircling the upper extent of the outer container 17 there is a flange comprising a horizontal annular portion 24, a depending cylindrical portion 26 and an upstanding slightly outwardly flared portion 27. Encircling the upper extent of the inner container 16 there is a second horizontal annular portion 28 with a peripheral second depending portion 29. The inner 16 and outer 17 containers are preferably made of resilient materials such as polypropylene and polyethylene so that the inner side of the second depending portion resiliently engages the outer side of the upstanding portion 27 in a well known manner thereby by forming a unitary, yet disassembleable container 10.

Figure 5:
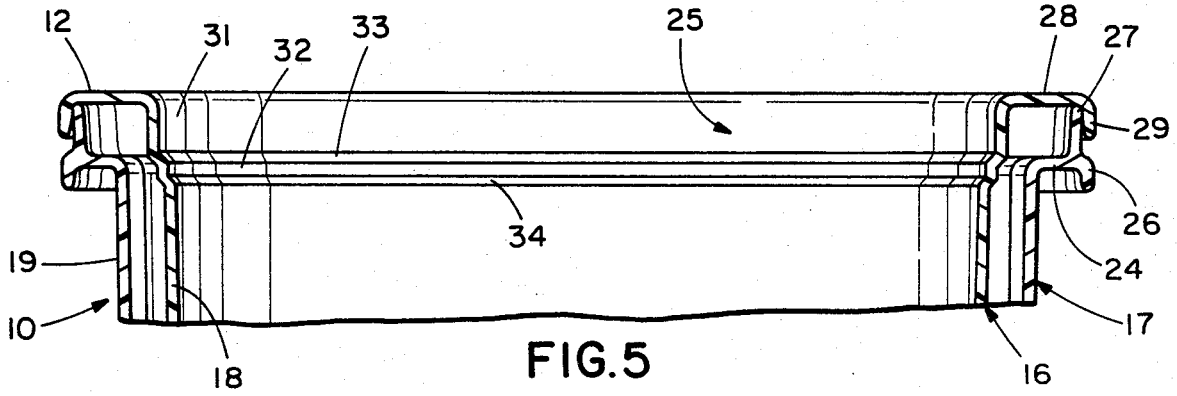
FIG. 5 is similar to FIG. 4, but with the seal removed.
Figure 6:
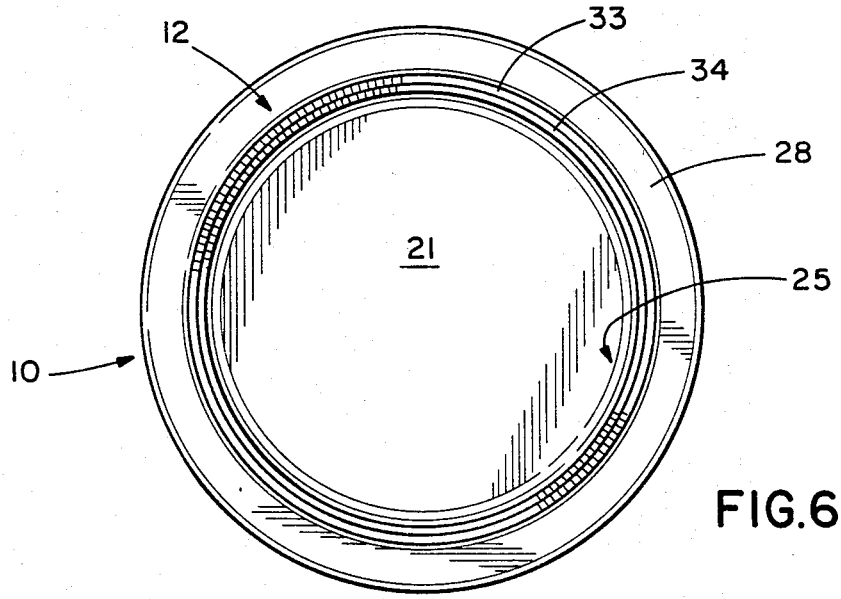
FIG. 6 is a top plan view of the ice bucket of FIG. 1 with the seal removed.

As is most easily seen in FIGS. 5 and 6, at the upper extent of the wall 18 of the inner container 16 there is formed a throat opening 25 substantially circular in plan. Formed in the throat opening 25 there is a substantially cylindrical first wall portion 31. Adjacent and below the first wall portion 31 there is formed in the throat opening 25 a substantially cylindrical second wall portion 32 having a diameter less than that of the first wall portion 31. Between the first 31 and second 32 wall portions there is formed an annular, inwardly extending first ledge 33. Below the second wall portion 32 there is formed an annular, inwardly extending second ledge 34. Thus, there are upper and lower concentric ledges, the upper first ledge 33 having a greater diameter than the lower second ledge 34.

Referring to FIG. 3, there is illustrated a seal 11 tightly covering the container 10. The seal is constructed in accordance with the disclosure of U.S. Pat. No. 3,756,480 which patent should be consulted for a detailed description of its construction and operation. Briefly described, the seal 11 includes in its general organization an elastically deformable seal member 36, a top wall 37, and a plunger 13. About the periphery of the seal member 36 there is a bead portion 38 and an upstanding rim 39. The upper edge of the rim 39 engages the circumferencial edge of the top wall 37.

The bead portion 38 has a circumferential outer edge 41 and an underside 42. The throat opening 25 of the inner container 16 and the seal 11 are dimensioned so that when the seal member 36 is in its relaxed, undistorted state, the inner diameter of the first wall portion 31 is slightly greater than the outer diameter of the bead outer edge 41, and the inner diameter of the second wall portion 32 is slightly less than the outer diameter of the bead outer edge 41. Furthermore, the inner diameter of the second wall portion 32 is substantially equal to or slighly greater than the outer diameter of the bead outer edge 41 when the seal member 36 is in its distorted state and the bead is contracted.

Figure 4:
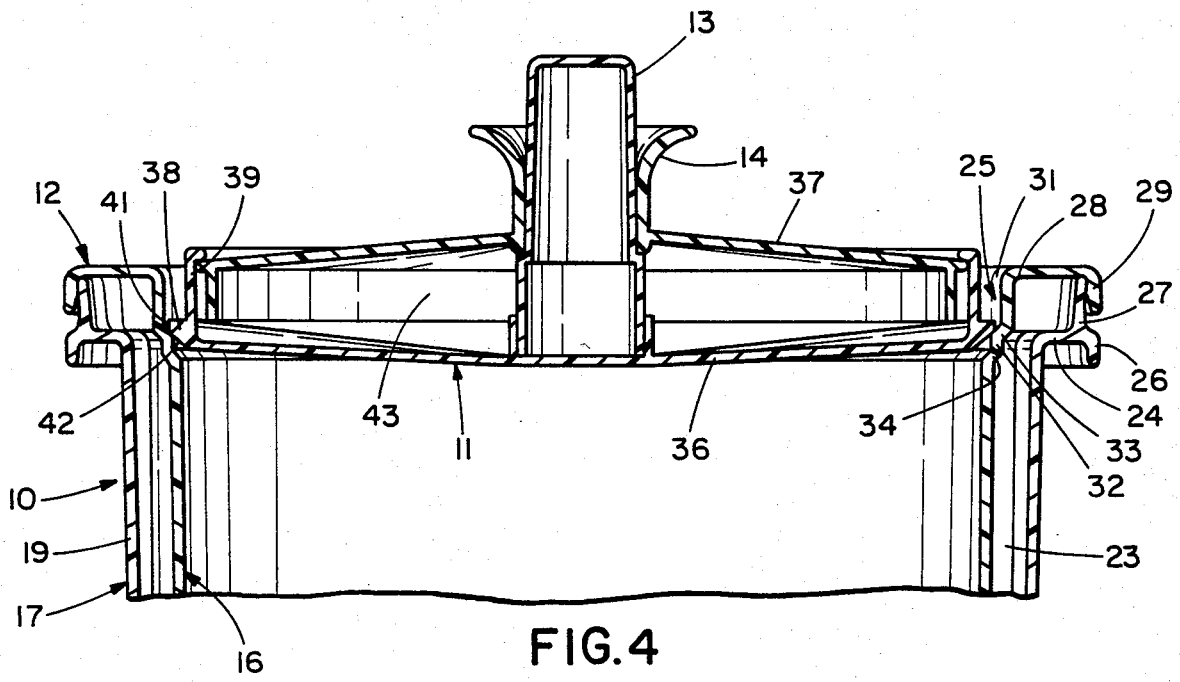
FIG. 4 is a fragmentary sectional view similar to FIG. 3, but showing the seal in the loose resting position.

FIGS. 3 and 4 illustrate the two closing modes of the closure of the invention. In FIG. 3, the closure is in the tight sealing mode. The seal 11 is readied for insertion by depressing the plunger 13 which acts upon the center of the seal member 36 to distort the seal member 36 and contract the bead portion 38 to a diameter small enough for the seal 11 to be inserted into the throat opening 25 with the bead underside 42 contacting the second ledge 34. After insertion, the plunger 13 is released and elastic forces in the seal member 36 uniformly urge the bead portion 38 outward. The container 10 is thus tightly sealed with bead outer edge 41 firmly engaging the second wall portion 32 and the bead underside 42 seated upon the second ledge 34. The seal 11 may be removed by reversing the process just described.

In FIG. 4, the closure is shown in the loose covering mode. The seal 11 is inserted in its undistorted state into the throat opening 25 until the bead underside 42 comes to rest atop the first ledge 33. A small annular gap is formed between the bead outer edge 41 and the first wall portion 31. The seal 11 rests properly centered and oriented horizontally without wedging or binding. No gaps are left between the bead underside 42 and first ledge 33. The seal 11 may be removed and replaced with ease.

According to the preferred embodiment, the first ledge 33, second ledge 34, and bead underside 41 are equally sloped, thereby imposing a centering action on the seal 11. Although the first wall portion 31 and second wall portion 32 are substantially cylindrical, it is desirable to form the wall portions with an upward and outward draft angle for assistance in centering the seal 11 and for facilitating unmolding of the container in its manufacture. In the preferred embodiment, the draft angle is one degree from the vertical. It is within the scope of the invention to provide other draft angles or ledge slopes, although the ledges must be close enough to horizontal so that no wedging action occurs.

It should be appreciated that when the invention is practiced according to the preferred embodiment, the dead air space 43 of the seal 11 between the seal member 36 and top wall 37 is useful for thermally insulating the contents of the container 11. It should be understood, however, that the closure of the invention is not limited to use in ice buckets or other thermal containers.

While the invention has been described with reference to a specific preferred embodiment, it should be understood that it is wished to embody within the patent warranted hereon all modifications and variations which come within the scope of this invention's contribution to the art.

I claim:

1. In a closure for a container of the type having a generally circular throat opening and a closure member of the type comprising an elastically distortable seal member having a peripheral bead portion selectively contractable from a first bead diameter to a second, smaller bead diameter, said bead portion being releasably, sealingly engageable with the inner surface of said throat opening, the combination therewith comprising:

a first wall portion formed in said throat opening having a diameter greater than said first bead diameter;

a second wall portion formed in said throat opening below and adjacent said first wall portion having a diameter less than said first bead diameter and at least equal to said second bead diameter;

a first annular ledge extending inwardly and disposed between said first wall portion and said second wall portion; and a second annular ledge extending inwardly below said second wall portion.

2. A closure for a container having a generally circular throat opening, said closure comprising:

a generally circular, elastically distortable seal member having a peripheral bead portion selectively, elastically contractable from;

a first bead diameter to a second, smaller bead diameter, said bead portion being releasably, sealingly engageable with the inner surface of said throat opening;

a substantially cylindrical first wall portion formed in said throat opening having a diameter greater than said first bead diameter;

a substantially cylindrical second wall portion formed in said throat opening below and adjacent said first wall portion and having a diameter less than said first bead diameter and at least equal to said second bead diameter, said second wall portion being engageable by said bead portion for tight sealing of said container;

a first annular ledge extending inwardly and disposed between said first wall portion and said second portion, said bead portion being restable upon said first annular ledge for loose covering of said container; and a second annular ledge extending inwardly below said second wall portion, said bead portion being seatable upon said second annular ledge for tight sealing of said container.

3. The closure of claim 1 wherein the seal member is a three-part press type seal.

4. The closure of claim 3 where the dead air space within the three-part seal is used for thermal insulation.

5. The closure of claim 1 wherein the container is an ice bucket.

6. The closure of claim 1 wherein the first and second annular ledges and the bead portion underside are equally sloped downwardly and inwardly.

7. The closure of claim 1 wherein the first and second wall portions are substantially cylindrical.

8. The closure of claim 1 wherein the bead portion is restable upon the first annular ledge for loose covering of the container.

9. The closure of claim 1 wherein the bead portion is seatable upon the second annular ledge for tight sealing of the container.

10. In a closure for a container of the type having a generally circular throat opening and a closure member of the type comprising an elastically distortable seal member having a peripheral bead portion selectively contractible from a first bead diameter to a second, smaller bead diameter, said bead portion being releasably, sealingly engageable with the inner surface of said throat opening, the combination therewith comprising:

a wall portion formed in said throat opening having a diameter less than said first bead diameter and at least equal to said second bead diameter;

a first annular ledge extending outwardly of the upper extent of said wall portion; and a second annular ledge extending inwardly of the lower extent of said wall portion.

* * * * *